US009574584B2

(12) United States Patent
Funato

(10) Patent No.: US 9,574,584 B2
(45) Date of Patent: Feb. 21, 2017

(54) FLUID PRESSURE CYLINDER

(71) Applicant: KAYABA INDUSTRY CO., LTD., Tokyo (JP)

(72) Inventor: Hiroshi Funato, Gifu (JP)

(73) Assignee: KYB Corporation, Tokyo (JP)

( * ) Notice: Subject to any disclaimer, the term of this patent is extended or adjusted under 35 U.S.C. 154(b) by 334 days.

(21) Appl. No.: 14/387,236

(22) PCT Filed: Feb. 21, 2013

(86) PCT No.: PCT/JP2013/054284

§ 371 (c)(1),
(2) Date: Sep. 22, 2014

(87) PCT Pub. No.: WO2013/140935

PCT Pub. Date: Sep. 26, 2013

(65) Prior Publication Data

US 2015/0047499 A1 Feb. 19, 2015

(30) Foreign Application Priority Data

Mar. 23, 2012 (JP) ..... 2012-067074

(51) Int. Cl.
*F15B 15/22* (2006.01)

(52) U.S. Cl.
CPC ..... *F15B 15/22* (2013.01); *F15B 15/222* (2013.01)

(58) Field of Classification Search
CPC ..... F15B 15/22; F15B 15/222; F15B 15/227; F01B 11/02
See application file for complete search history.

(56) References Cited

U.S. PATENT DOCUMENTS

2006/0151269 A1* 7/2006 Ikeda ..... F15B 15/222 188/267

FOREIGN PATENT DOCUMENTS

| | | | |
|---|---|---|---|
| JP | 60-021522 Y2 | | 6/1985 |
| JP | 62-008402 U | | 1/1987 |
| JP | 04-38094 A | | 9/1992 |
| JP | 05-045206 U | | 6/1993 |
| JP | 11-230117 A | | 8/1999 |
| JP | 2000-274409 A | | 10/2000 |
| JP | 2000274409 A | * | 10/2000 |
| JP | 2001-082415 A | | 3/2001 |

* cited by examiner

*Primary Examiner* — Thomas E Lazo
*Assistant Examiner* — Abiy Teka
(74) *Attorney, Agent, or Firm* — Rabin & Berdo, P.C.

(57) ABSTRACT

A cushion mechanism for decelerating a piston rod includes a holder fastened to an end surface of a cylinder portion fitted with an inner peripheral surface of a cylinder tube, an annular entry portion provided on the piston rod and advancing into the holder and the cylinder portion in the vicinity of the stroke end, a cushion passage leading a working fluid of the working chamber to a supply/discharge port, and an orifice plug fastened to the cushion passage, and the cushion passage includes an internal passage extending in a radial direction of the holder and to which the orifice plug is fastened, and the orifice plug is replaceable through a replacement port formed by penetrating the cylinder tube and communicating with the internal passage.

8 Claims, 4 Drawing Sheets

FLUID PRESSURE CYLINDER

TECHNICAL FIELD

The present invention relates to a fluid pressure cylinder used as an actuator.

BACKGROUND ART

A hydraulic cylinder used for a hydraulic excavator or the like is generally provided with a cushion mechanism for decelerating a piston rod by generating a cushion pressure in the vicinity of a stroke end of the piston rod.

As this type of hydraulic cylinders, JP2001-82415A discloses a hydraulic cylinder in which a passage 15 extending from a working chamber 9 toward a port 11 and a reducing hole 18 allowing an opening portion 17 and the passage 15 to communicate and playing a role of limiting a flow rate of a working fluid of the working chamber 9 and discharging it toward a port 11 are formed in a fitting portion 3 of a first covering member 2 closing an end-surface opening by covering a cylinder tube 1, and a cushion ring 19 is provided on the piston rod 6 adjacent to the piston 5. The cushion ring 19 plays a role of closing a diameter-enlarged hole 13a when the piston rod 6 moves to a direction of discharging the working fluid of the working chamber 9 by being fitted in the diameter-enlarged hole 13a in the vicinity of its movement end. As a result, the working fluid of the working chamber 9 is discharged toward the port 11 via the reducing hole 18 from the opening portion 17 while its flow rate is limited, and a cushion action is applied at the movement end of the piston rod 6.

SUMMARY OF INVENTION

In the hydraulic cylinder described in JP2001-82415A, when cushioning performances are to be adjusted, it is necessary to remove the first covering member from a cylinder tube and to adjust the diameter of the reducing hole.

The present invention was made in view of the above-described problems and has an object of providing a fluid pressure cylinder which can adjust cushion performances easily.

According to an aspect of the present invention, a fluid pressure cylinder of which a piston rod fastened to a piston is provided capable of reciprocating in a cylinder tube includes, a closing member for closing an end opening portion of the cylinder tube, a working chamber defined between the closing member and the piston, a supply/discharge port formed in the closing member and communicating with the working chamber, and a cushion mechanism for decelerating the piston rod in the vicinity of a stroke end when a working fluid of the working chamber is discharged through the supply/discharge port and the piston rod makes a stroke are provided, the cushion mechanism includes a cylinder portion fitted with an inner peripheral surface of the cylinder tube, an annular holder fastened to an end surface of the cylinder portion, an annular entry portion provided annularly on the piston rod and advancing into the holder and the cylinder portion in the vicinity of the stroke end, a cushion passage formed on the holder and leading the working fluid of the working chamber to the supply/discharge port when the annular entry portion enters into the holder and the cylinder portion, and an orifice plug fastened to the cushion passage and applying resistance to a flow of the working fluid, the cushion passage includes an inlet passage formed between an inner peripheral surface of the cylinder tube and an outer peripheral surface of the holder and an internal passage opened in the outer peripheral surface of the holder and extending in a radial direction of the holder and to which the orifice plug is fastened, and the orifice plug is replaceable through a replacement port formed penetrating the cylinder tube and communicating with the internal passage.

Embodiments and advantages of the present invention will be explained below in detail by referring to the attached drawings.

DESCRIPTION OF EMBODIMENTS

A hydraulic cylinder 1 as a fluid pressure cylinder according to an embodiment of the present invention will be explained by referring to the attached drawings.

The hydraulic cylinder 1 is used as an actuator mounted on a construction machine or an industrial machine. For example, the hydraulic cylinder 1 is used as an arm cylinder mounted on a hydraulic excavator, and an arm of the hydraulic excavator is rotationally moved by a telescopic operation of the hydraulic cylinder 1.

Figure 1:
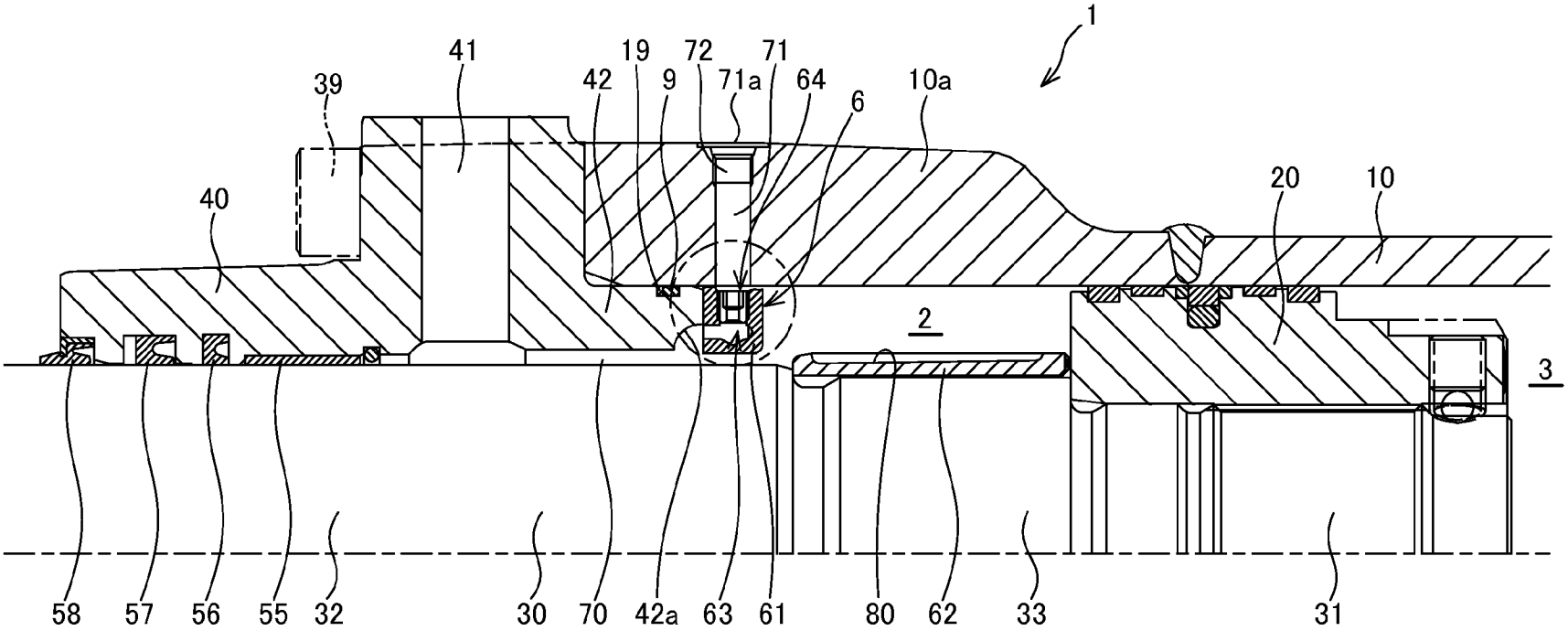
FIG. 1 is a sectional view of a fluid pressure cylinder of an embodiment of the present invention and illustrates a state in which a piston rod is in a stroke region in which a cushion action by a cushion mechanism is not exerted.
Figure 2:
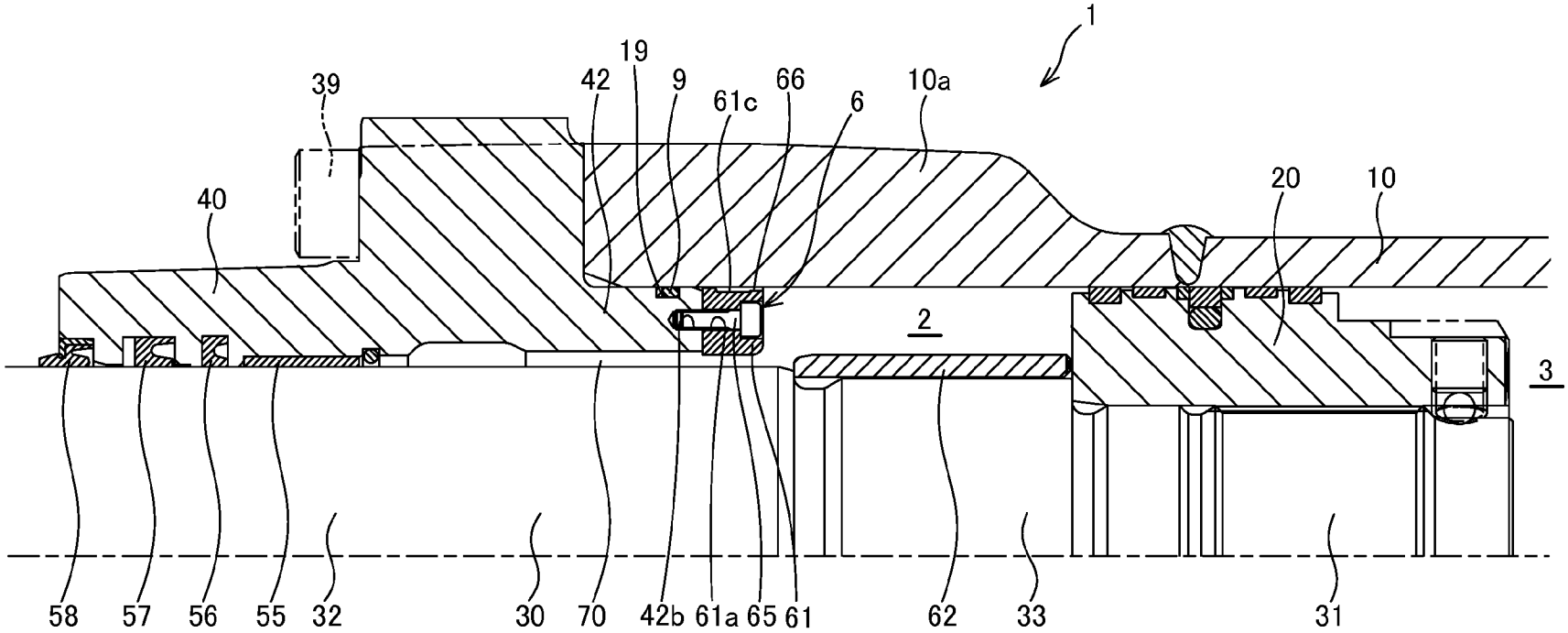
FIG. 2 is a sectional view of the fluid pressure cylinder of the embodiment of the present invention and illustrates a state in which the piston rod is in the stroke region in which the cushion action by the cushion mechanism is not exerted, showing a section different from that in FIG. 1.

As illustrated in FIGS. 1 and 2, the hydraulic cylinder 1 includes a cylindrical cylinder tube 10, a piston 20 slidably inserted into the cylinder tube 10 and dividing an inside of the cylinder tube 10 into a rod-side chamber 2 as a working chamber and a counter-rod-side chamber 3, and a piston rod 30 reciprocating in the cylinder tube 10 and having one end thereof connected to the piston 20 and the other end extending to an outside of the cylinder tube 10.

The rod-side chamber 2 and the counter-rod-side chamber 3 communicate with a hydraulic pump as a hydraulic-pressure supply source or a tank through a switching valve. When one of the rod-side chamber 2 and the counter-rod-side chamber 3 communicate with the hydraulic pump, the other communicates with the tank. The hydraulic cylinder 1 is telescopically operated when a working oil (working fluid) is led to the rod-side chamber 2 or the counter-rod-side chamber 3 from the hydraulic pump, whereby the piston rod 30 is moved in an axial direction. A working fluid such as an aqueous substitution liquid or the like, for example, may be used instead of oil.

The end opening portion of the cylinder tube 10 is closed by a cylinder head 40 as a closing member. The piston rod 30 is slidably inserted through the cylinder head 40 and is supported by the cylinder head 40. The cylinder head 40 is a substantially cylindrical member and is fastened to a flange portion 10*a* formed on an end portion of the cylinder tube 10 by a bolt 39.

On an inner peripheral surface of the cylinder head 40, a bearing 55, a sub seal 56, a main seal 57, and a dust seal 58 are juxtaposed and interposed, and they are brought into sliding contact with an outer peripheral surface of the piston rod 30. The bearing 55 supports the piston rod 30 so that the piston rod 30 can move in an axial direction of the cylinder tube 10.

On the cylinder head 40, a supply/discharge port 41 communicating with the rod-side chamber 2 is formed. A hydraulic pipeline is connected to the supply/discharge port 41, and the hydraulic pipeline is connected to the hydraulic pump or the tank through the switching valve.

Moreover, on the cylinder head 40, a cylinder portion 42 fitted with the inner peripheral surface of the cylinder tube 10 is formed. On an outer peripheral surface of the cylinder portion 42, an O-ring 9 and a backup ring 19 for sealing a space from the inner peripheral surface of the cylinder tube 10 are interposed. The cylinder portion 42 may be provided separately from the cylinder head 40.

The piston rod 30 includes a small-diameter portion 31 formed on a tip end portion and to which the piston 20 is fastened, a large-diameter portion 32 sliding with the inner peripheral surface of the cylinder head 40 and having a diameter larger than that of the small-diameter portion 31, and a medium-diameter portion 33 formed between the small-diameter portion 31 and the large-diameter portion 32 and on which an annular cushion ring 62 which will be described later is provided. A diameter of the medium-diameter portion 33 is larger than that of the small-diameter portion 31 and smaller than that of the large-diameter portion 32. The cushion ring 62 is not removed from the piston rod 30 since it is sandwiched between the piston 20 and the large-diameter portion 32.

When the hydraulic pump communicates with the rod-side chamber 2, and the tank communicates with the counter-rod-side chamber 3, the working oil is supplied to the rod-side chamber 2 through the supply/discharge port 41, and the working oil in the counter-rod-side chamber 3 is discharged to the tank. As a result, the piston rod 30 moves to a right direction in FIG. 1, and the hydraulic cylinder 1 performs a contraction operation.

Figure 3:
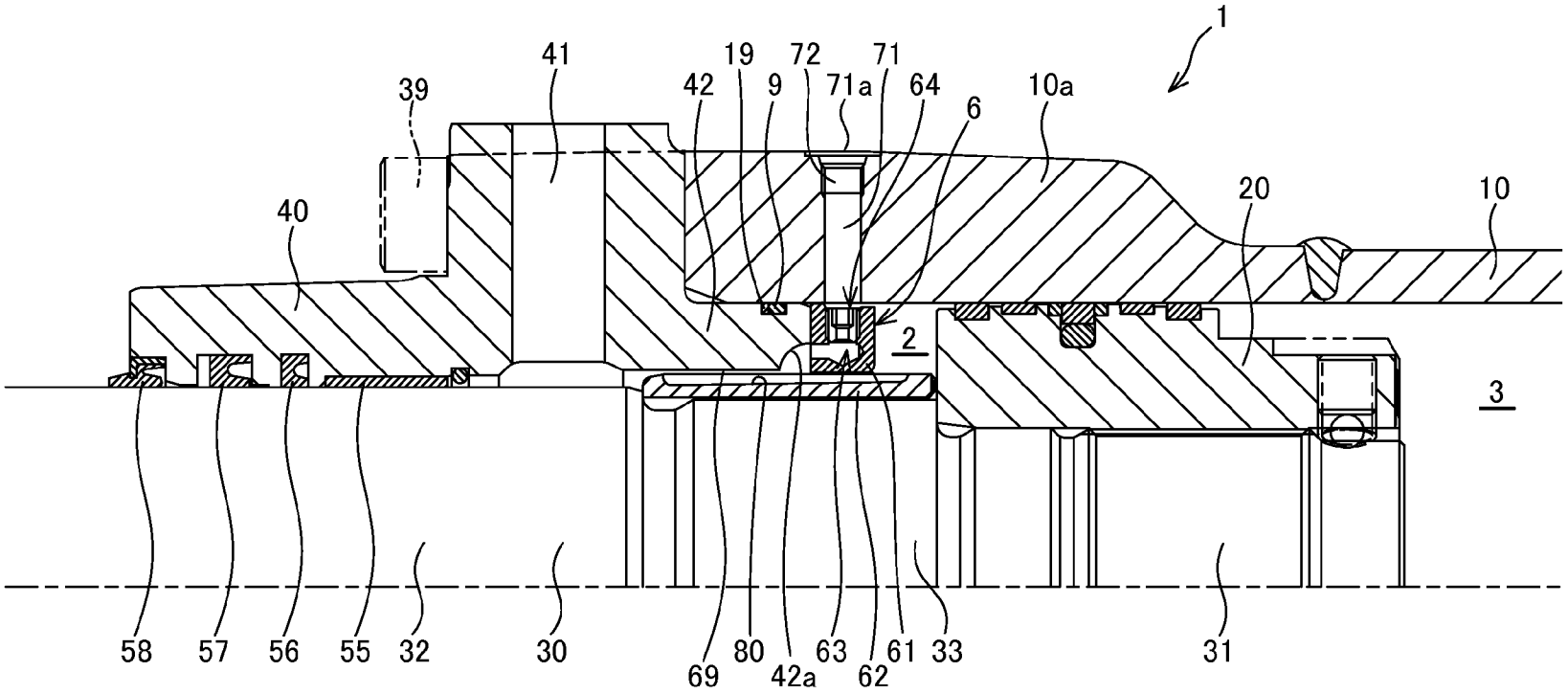
FIG. 3 illustrates a state in which the piston rod is located in the vicinity of a stroke end when the fluid pressure cylinder performs an extension operation.

On the other hand, when the hydraulic pump communicates with the counter-rod-side chamber 3, and the tank communicates with the rod-side chamber 2, the working oil is supplied to the counter-rod-side chamber 3, and the working oil in the rod-side chamber 2 is discharged to the tank through the supply/discharge port 41. As a result, the piston rod 30 moves to a left direction in FIG. 1, and the hydraulic cylinder 1 performs extension operation. The hydraulic cylinder 1 is provided with the cushion mechanism 6 for decelerating the piston rod 30 in the vicinity of a stroke end during an extension operation. FIGS. 1 and 2 illustrate a state in which the piston rod 30 is in a normal stroke region, and the cushion mechanism 6 does not exert a cushion action. FIG. 3 illustrates a state in which the piston rod 30 is in the vicinity of the stroke end during the extension operation of the hydraulic cylinder 1, and the cushion mechanism 6 exerts the cushion action.

The cushion mechanism 6 will be explained below in detail by referring mainly to FIGS. 3 and 4.

The cushion mechanism 6 includes an annular holder 61 fastened to an end surface of the cylinder portion 42 of the cylinder head 40, a cushion ring 62 as an annular entry portion provided on the medium-diameter portion 33 of the piston rod 30 and advancing into the holder 61 and the cylinder portion 42 in the vicinity of the stroke end, a cushion passage 63 formed in the holder 61 and leading the working oil in the rod-side chamber 2 to the supply/discharge port 41 when the cushion ring 62 enters into the holder 61 and the cylinder portion 42, and an orifice plug 64 fastened in the cushion passage 63 and applying resistance to the flow of the working oil.

The holder 61 is arranged by being juxtaposed with the cylinder portion 42 along the inner peripheral surface of the cylinder tube 10. As illustrated in FIG. 2, a plurality of fastening holes 61*a* penetrating in an axial direction are formed in the holder 61 in a circumferential direction, and a plurality of fastening holes 42*b* corresponding to the fastening holes 61*a* of the holder 61 are formed in an end surface in the cylinder portion 42 faced with the holder 61. The holder 61 is fastened to the cylinder portion 42 by a fastening bolt 65 screwed with the fastening holes 61*a* and the fastening holes 42*b*. As described above, the holder 61 is fastened to the cylinder portion 42 by a plurality of the fastening bolts 65.

The cushion ring 62 is formed so that an outer diameter thereof is larger than an outer diameter of the large-diameter portion 32 of the piston rod 30. Therefore, when the piston rod 30 is located in a stroke region in which the cushion action by the cushion mechanism is not exerted during the extension operation of the hydraulic cylinder 1, as illustrated in FIGS. 1 and 2, the working oil in the rod-side chamber 2 is led to the supply/discharge port 41 through an annular passage 70 defined between the outer peripheral surface of the large-diameter portion 32 and the inner peripheral surfaces of the holder 61 and the cylinder portion 42 and discharged. On the other hand, when the piston rod 30 is in the vicinity of the stroke end during the extension operation of the hydraulic cylinder 1, as illustrated in FIG. 3, the cushion ring 62 having the diameter larger than that of the large-diameter portion 32 enters into the holder 61 and the cylinder portion 42 and thus, a pressure in the rod-side chamber 2 rises, and the piston rod 30 is decelerated. In this way the cushion action is exerted. Hereinafter, the pressure in the rod-side chamber 2 during a cushion operation when the cushion action is exerted will be referred to as a "cushion pressure".

During the cushion operation, the working oil in the rod-side chamber 2 is discharged to the supply/discharge port 41 through the cushion passage 63 to which the orifice plug 64 is fastened. Therefore, the cushion pressure can be adjusted by changing an orifice diameter of the orifice plug 64. If the cushion pressure is to be adjusted by the orifice, it is hardly subjected to viscosity of the working oil, and thus, an advantage that the cushion performance is made stable can be obtained.

The holder 61 is preferably formed so that the outer peripheral surface of the cushion ring 62 slides on the inner peripheral surface thereof. As a result, when the cushion ring 62 enters into the holder 61, the working oil in the rod-side chamber 2 scarcely flows into a space between the inner peripheral surface of the holder 61 and the outer peripheral surface of the cushion ring 62 but flows into the cushion passage 63 formed in the holder 61. As described above, the cushion passage 63 to which the orifice plug 64 is fastened can be made as a main passage.

Figure 4:
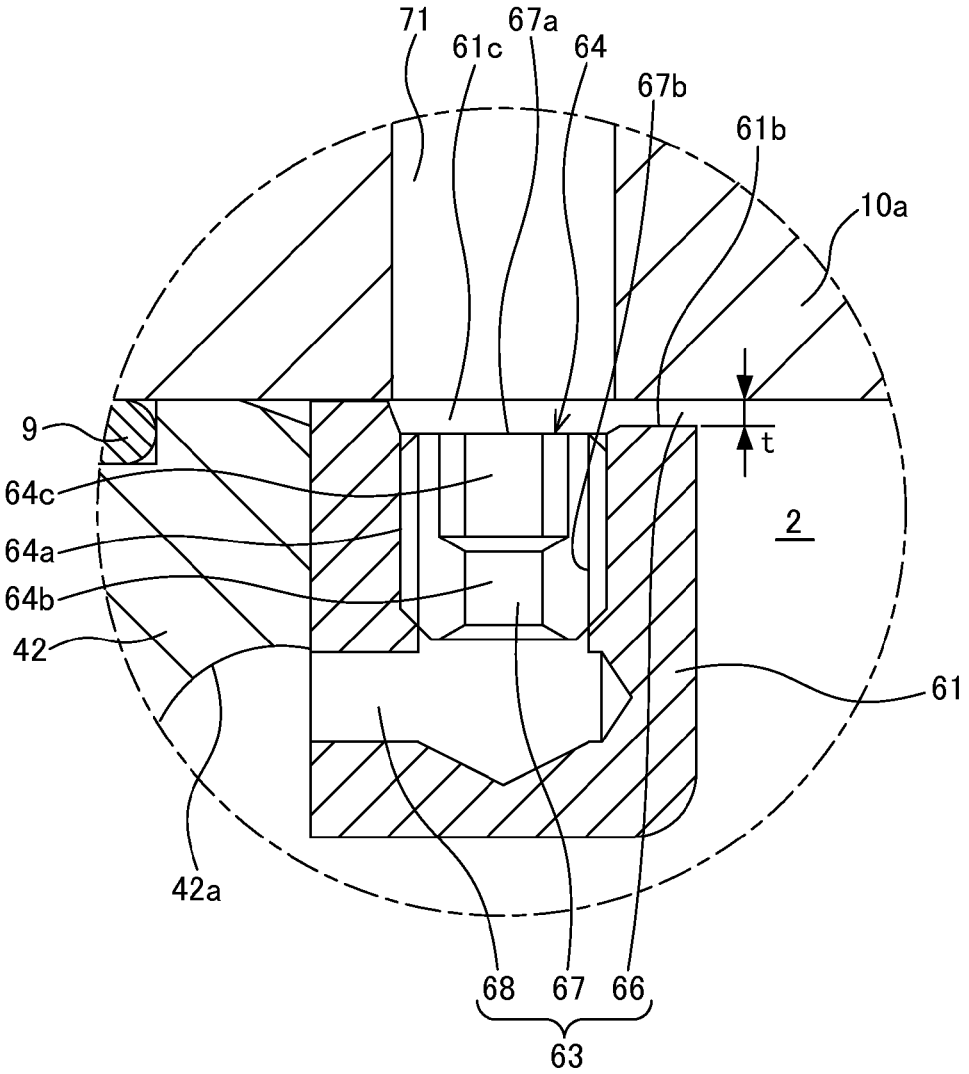
FIG. 4 is an enlarged view of a portion surrounded by a one-dot chain line in FIG. 1.

As illustrated in FIG. 4, the cushion passage 63 includes an inlet passage 66 formed between the inner peripheral surface of the cylinder tube 10 and the outer peripheral surface of the holder 61, an internal passage 67 having an opening portion 67*a* opened to the outer peripheral surface of the holder 61 and extending in a radial direction of the holder 61, and an outlet passage 68 communicating with the internal passage 67, opened to a rear surface on the cylinder portion 42 side of the holder 61 and communicating with a notch portion 42*a* formed on an inner peripheral edge of the cylinder portion 42.

The inlet passage 66 is formed as an annular gap that is formed between an outer peripheral surface 61*b* on the rod-side chamber 2 side of the holder 61 and an inner peripheral surface of the cylinder tube 10.

A female screw 67*b* is formed on an inner peripheral surface of the internal passage 67, the female screw 67*b* is screwed with a male screw 64*a* formed on an outer peripheral surface of the orifice plug 64 and fastened thereto. The orifice plug 64 has an orifice portion 64*b* throttling the flow of the working oil.

An annular groove 61*c* is formed over an entire periphery of the outer peripheral surface of the holder 61. The annular groove 61*c* allows the inlet passage 66 and the internal passage 67 to communicate with each other. Therefore, during the cushion operation, the working oil in the rod-side chamber 2 is led to the annular groove 61*c* through the inlet passage 66, flows into the internal passage 67, passes through the orifice portion 64*b* of the orifice plug 64 and is discharged from the outlet passage 68.

As illustrated in FIG. 3, when the cushion ring 62 enters into the cylinder portion 42, an annular gap 69 communicating with the supply/discharge port 41 is defined between the outer peripheral surface of the cushion ring 62 and the inner peripheral surface of the cylinder portion 42. Therefore, the working oil discharged from the outlet passage 68 is led to the supply/discharge port 41 through the notch portion 42*a* of the cylinder portion 42 and the annular gap 69.

A diameter of the orifice portion 64*b* of the orifice plug 64 is larger than a dimension of the inlet passage 66 in a radial direction (a dimension t illustrated in FIG. 4). As a result, even if a foreign substance having a size that cannot pass through the orifice portion 64*b* is mixed in the working oil, the foreign substance cannot pass through the inlet passage 66, and the foreign substance does not clog the orifice portion 64*b*. Therefore, the cushion passage 63 is prevented from being closed by a foreign substance during the cushion operation.

A replacement port 71 communicating with the internal passage 67 of the holder 61 and used for replacing the orifice plug 64 is formed on the flange portion 10*a* of the cylinder tube 10 by penetrating the inner/outer peripheral surfaces. The replacement port 71 is sealed by a plug 72 fastened to an opening portion 71*a* opened in an outer peripheral surface of the flange portion 10*a* in a normal time.

When the orifice plug 64 is to be replaced, the plug 72 is removed, and a tool such as a screwdriver or the like is inserted into the replacement port 71 through the opening portion 71*a* and is engaged with a tool engagement hole 64*c* formed in the orifice plug 64. Then, by rotating the tool so as to rotate the orifice plug 64, fastening of the orifice plug 64 to the internal passage 67 is released, and the orifice plug 64 is taken out of the hydraulic cylinder 1 from the replacement port 71. Moreover, the orifice plug 64 having a desired orifice diameter is inserted into the replacement port 71 and is fastened to the internal passage 67 by using the tool. As described above, the orifice plug 64 can be replaced through the replacement port 71 formed on the cylinder tube 10, and adjustment of the cushion performances can be made without removing the cylinder head 40 from the cylinder tube 10.

As illustrated in FIG. 3, a notch 80 of which a channel sectional area gradually decreases as the piston rod 30 goes closer to the stroke end is preferably formed on the outer peripheral surface of the cushion ring 62. By forming the notch 80 on the outer peripheral surface of the cushion ring 62, the working oil in the rod-side chamber 2 flows through the cushion passage 63 and also flows to the notch 80 and is discharged to the supply/discharge port 41 during the cushion operation. In this case, it is preferably configured such that a gap between the outer peripheral surface of the cushion ring 62 and the inner peripheral surface of the holder 61 becomes as small as possible and the outer peripheral surface of the cushion ring 62 slides on the inner peripheral surface of the holder 61, and the working oil mainly flows the cushion passage 63. That is, it is preferably configured such that a flow rate discharged through the cushion passage 63 is larger than the flow rate discharged through the notch 80. By configuring as above, the cushion passage 63 having the orifice portion 64*b* becomes the main passage. Thus, adjustment of cushion performances can be made mainly by the orifice which is hardly subjected to viscosity of the working oil, and cushion performances can be made stable. On the other hand, the adjustment of the cushion performances according to the stroke of the piston rod 30 is made by adjusting a width and a depth of the notch 80.

According to the above-described embodiment, the following effects are exerted.

The orifice plug 64 is fastened to the cushion passage 63 which leads the working oil from the rod-side chamber 2 to the supply/discharge port 41 during the cushion operation. The orifice plug 64 is replaceable through the replacement port 71 formed on the cylinder tube 10. Thus, adjustment of the cushion performances can be made only by replacement to the orifice plug 64 having a desired orifice diameter through the replacement port 71. As described above, since adjustment of the cushion performances can be made without removing the cylinder head 40 from the cylinder tube 10 and in a state in which the hydraulic cylinder 1 is attached to the hydraulic excavator, the cushion performances can be adjusted easily.

Moreover, adjustment of the cushion performances is made by changing the orifice diameter by replacing the orifice plug 64. Since the orifice is hardly subjected to viscosity of the working oil, the cushion performances can be made stable as compared with the prior-art method of adjusting the cushion performances by an annular gap 69 between the outer peripheral surface of the cushion ring 62 and the inner peripheral surface of the cylinder portion 42. Moreover, in the prior-art method of adjusting the cushion performances by the annular gap 69, the cushion performances are subjected to machining accuracy of the outer peripheral surface of the cushion ring 62 and the inner peripheral surface of the cylinder portion 42, coaxiality of the cushion ring 62 and the cylinder portion 42 and the like and varied and cannot be made stable easily. However, in this embodiment, the adjustment of the cushion performances is made by changing the orifice diameter, and variation in the cushion performances is suppressed, and the cushion performances can be made stable.

A variation of this embodiment is illustrated below.

In the above-described embodiment, the cushion ring 62 is configured to be provided in the medium-diameter portion 33 of the piston rod 30. Instead, the cushion ring 62 may be abolished, and the medium-diameter portion 33 may be formed to have an outer diameter larger than that of the large-diameter portion 32 of the piston rod 30. However, in this case, there is a concern that the outer peripheral surface of the medium-diameter portion 33 is caught by the holder 61 or the inner peripheral surface of the cylinder portion 42, and a stroke of the piston rod 30 may be interfered during the cushion operation. On the other hand, as in the above-described embodiment, in the configuration in which the cushion ring 62 is provided in the medium-diameter portion 33 of the piston rod 30, by configuring such that the cushion ring 62 is floating-supported so as to be slightly movable in a radial direction with respect to the piston rod 30, the outer peripheral surface of the cushion ring 62 can be prevented from being caught by the holder 61 or the inner peripheral surface of the cylinder portion 42. Thus, provision of the cushion ring 62 on the medium-diameter portion 33 of the piston rod 30 is more preferable than formation of the medium-diameter portion 33 so as to have an outer diameter larger than that of the large-diameter portion 32 of the piston rod 30.

Moreover, in the above-described embodiment, the inlet passage 66 of the cushion passage 63 is formed annularly between the outer peripheral surface 61*b* of the holder 61 and the inner peripheral surface of the cylinder tube 10. Instead, a groove allowing the rod-side chamber 2 and the annular groove 61*c* to communicate with each other may be formed on the outer peripheral surface of the holder 61 so as to constitute the inlet passage 66.

Embodiments of this invention were described above, but the above embodiments are merely examples of applications of this invention, and the technical scope of this invention is not limited to the specific constitutions of the above embodiments.

For example, in the above-described embodiment, the example in which the fluid pressure cylinder is attached to the hydraulic excavator is illustrated, but the fluid pressure cylinder may be attached to other construction machines.

The invention claimed is:

1. A fluid pressure cylinder of which a piston rod fastened to a piston is provided capable of reciprocating in a cylinder tube, comprising:

a closing member adapted to close an end opening portion of the cylinder tube;

a working chamber defined between the closing member and the piston;

a supply/discharge port formed in the closing member and communicating with the working chamber; and a cushion mechanism adapted to decelerate the piston rod in the vicinity of a stroke end when a working fluid of the working chamber is discharged through the supply/discharge port and the piston rod makes a stroke, wherein the cushion mechanism includes:

a cylinder portion fitted with an inner peripheral surface of the cylinder tube;

an annular holder fastened to an end surface of the cylinder portion;

an annular entry portion provided annularly on the piston rod and advancing into the holder and the cylinder portion in the vicinity of the stroke end;

a cushion passage formed on the holder and leading the working fluid of the working chamber to the supply/discharge port when the annular entry portion enters into the holder and the cylinder portion; and an orifice plug fastened to the cushion passage and applying resistance to a flow of the working fluid; and the cushion passage includes:

an inlet passage formed between an inner peripheral surface of the cylinder tube and an outer peripheral surface of the holder; and an internal passage opened to the outer peripheral surface of the holder, extending in a radial direction of the holder, and to which the orifice plug is fastened; and the orifice plug is replaceable through a replacement port formed by penetrating the cylinder tube and communicating with the internal passage.

2. The fluid pressure cylinder according to claim 1, wherein the holder is formed so that an outer peripheral surface of the annular entry portion slides on an inner peripheral surface thereof; and when the annular entry portion enters into the holder and the cylinder portion, the working fluid having passed through the cushion passage is led to the supply/discharge port through an annular gap annularly defined between the outer peripheral surface of the annular entry portion and an inner peripheral surface of the cylinder portion.

3. The fluid pressure cylinder according to claim 1, wherein the annular entry portion is a cushion ring provided on an outer peripheral surface of the piston rod; and a notch of which a channel sectional area gradually decreases as the piston rod goes closer to the stroke end is formed on an outer peripheral surface of the cushion ring.

4. The fluid pressure cylinder according to claim 1, wherein the orifice plug has an orifice portion throttling a flow of the working fluid; and a diameter of the orifice portion is larger than a dimension of the inlet passage of the cushion passage in a radial direction.

5. The fluid pressure cylinder according to claim 3, wherein the notch is formed so that, when the annular entry portion enters into the holder and the cylinder portion, a flow rate of the working fluid discharged through the cushion passage is larger than the flow rate discharged through the notch.

6. The fluid pressure cylinder according to claim 2, wherein the annular entry portion is a cushion ring provided on an outer peripheral surface of the piston rod; and a notch of which a channel sectional area gradually decreases as the piston rod goes closer to the stroke end is formed on an outer peripheral surface of the cushion ring.

7. The fluid pressure cylinder according to claim 2, wherein the orifice plug has an orifice portion throttling a flow of the working fluid; and a diameter of the orifice portion is larger than a dimension of the inlet passage of the cushion passage in a radial direction.

8. The fluid pressure cylinder according to claim 6, wherein the notch is formed so that, when the annular entry portion enters into the holder and the cylinder portion, a flow rate of the working fluid discharged through the cushion passage is larger than the flow rate discharged through the notch.

* * * * *